US006354250B1

(12) United States Patent
Rodriguez Lopez

(10) Patent No.: US 6,354,250 B1
(45) Date of Patent: Mar. 12, 2002

(54) INTERNAL COMBUSTION ENGINE

(76) Inventor: Venancio Rodriguez Lopez, Av. Rivadavia 6003, Buenos Aires 1406 Cap. Fed. (AR)

( * ) Notice: Subject to any disclaimer, the term of this patent is extended or adjusted under 35 U.S.C. 154(b) by 0 days.

(21) Appl. No.: 09/575,507

(22) Filed: May 22, 2000

(30) Foreign Application Priority Data

Jun. 15, 1999 (AR) ..... P 99 01 02844

(51) Int. Cl.[7] ..... F02B 75/04
(52) U.S. Cl. ..... 123/48 R; 123/48 A; 123/78 A
(58) Field of Search ..... 123/48 R, 48 A, 123/78 A, 78 AA

(56) References Cited

U.S. PATENT DOCUMENTS

| | | | | |
|---|---|---|---|---|
| 1,093,317 | A | * | 4/1914 | Crouch et al. |
| 1,135,942 | A | | 4/1915 | Logan |
| 1,138,919 | A | | 5/1915 | Willey et al. |
| 1,461,080 | A | | 7/1923 | Berger |
| 1,464,164 | A | | 8/1923 | Alarie |
| 1,521,077 | A | | 12/1924 | Clegg |
| 1,557,710 | A | | 10/1925 | Lennon |
| 1,564,009 | A | | 12/1925 | Myers |
| 1,574,062 | A | | 2/1926 | Boehmer |
| 1,744,117 | A | | 1/1930 | Held |
| 1,835,138 | A | | 12/1931 | Bowman |
| 2,142,466 | A | * | 1/1939 | Wagner ..... 123/48 |
| 2,382,362 | A | | 8/1945 | Weinreb |
| 2,981,243 | A | | 4/1961 | Arndt |
| 3,139,074 | A | | 6/1964 | Winn |
| 3,312,206 | A | | 4/1967 | Radovic |
| 4,169,435 | A | | 10/1979 | Faulconer, Jr. |
| 4,250,843 | A | | 2/1981 | Chang |
| 5,195,469 | A | | 3/1993 | Syed |
| 5,197,432 | A | | 3/1993 | Ballheimer |
| 5,220,890 | A | | 6/1993 | Koriyama |

FOREIGN PATENT DOCUMENTS

| | | |
|---|---|---|
| DE | 31 17 133 | 11/1982 |
| EP | 0 426 540 | 5/1991 |
| EP | 0 438 121 | 7/1991 |
| WO | WO 92/09799 | 6/1992 |
| WO | WO 93/23664 | 11/1993 |
| WO | WO 94/00681 | 1/1994 |

* cited by examiner

*Primary Examiner*—Tony M. Argenbright
*Assistant Examiner*—Katrina B. Harris
(74) *Attorney, Agent, or Firm*—Merchant & Gould P.C.

(57) ABSTRACT

An internal combustion engine having at least one cylinder and a power piston reciprocatably moving within the cylinder, wherein the cylinder stationary head of a conventional engine is replaced by a control piston interrelated to the power piston to define a combustion chamber with variable volume, the control piston being actuated by an hydraulic transmission assembly.

15 Claims, 8 Drawing Sheets

12
E2
23
17
VIII
14
12
16
31
32
33
34
35
T1
25
P1
28
F
29
9
5
4
24
P7
T7
8
7
6
VIII 37
38
22
36
17
VII
21
20
21
15
21'
26
12
10
19
18
E1
E2
27
14
31
16
12
30
2'
11'2
1
28
25
11
3
5
9
P1
T1
T7
8
P7
VII
24
6
7

INTERNAL COMBUSTION ENGINE

BACKGROUND OF THE INVENTION

1. Field of the Invention

The present invention relates to an internal combustion engine with means for improving compression and combustion, as well as the air and mixture intake and gas exhaustion strokes or stages. More particularly the invention relates to an internal combustion engine comprising at least one cylinder and a power piston reciprocating within the cylinder, wherein the cylinder lacks the conventional stationary head and includes, instead of such head, a control piston reciprocating within the cylinder bore and interacting with the power piston to define, therebetween, a combustion chamber with variable volume, wherein the control piston is actuated by hydraulic transmission means.

2. Description of the Prior Art

It is well known to provide internal combustion engines with a cylinder head that is stationary to define, between the head and the power piston reciprocating within the cylinder bore of the engine a compression and combustion chamber. It is also known to replace the stationary head of the cylinder by a movable head or, better, by an additional piston that moves directly within the cylinder bore or within additional cavities or secondary bores to interrelate with the power piston to define a combustion and compression chamber with variable volume. All of the attempts made to design these double piston engines have failed in comprising a huge number of mechanical components wherein the friction forces, the couplings and adjustments to guarantee controlled cycles of operation have caused to make the operation of the engine very complex and unreliable.

U.S. Pat. No. 1,564,009 to Myers, discloses a gas engine comprising a cylinder, a piston and a moving head defined by a piston valve adapted to be adjusted with respect to said piston, whereby to vary the compression space, means for varying the compression space and the quantity of mixture taken into said cylinder. The valve piston is moving under the control of a spring and a cam having several profiles that cause the system to be practically impossible to be operated at high number of revolutions. In addition, no fluid pressure chambers are included to assist the valve piston to removing spent gases and to injecting mixture into the compression chamber.

U.S. Pat. No. 4,169,435 to Faulconer Jr. discloses an internal combustion engine with a power piston and a control piston moving against and far from each other to define between the pistons a combustion chamber, with the pistons being connected by a chain transmission system.

U.S. Pat. No. 3,312,206 to Radovic discloses an internal combustion engine with a cylinder housing two pistons reciprocating against and away from each other to define a variable chamber, one of the pistons being connected to a crankshaft and the other being actuated by a cam.

U.S. Pat. No. 3,139,074 to Winn discloses an internal combustion engine with a cylinder within which a pair of pistons reciprocate against and away from each other defining a variable chamber, with one of the pistons being connected to a crankshaft and the other being actuated by a set of articulated arms which in turn are moved by a cam-follower system.

Other internal combustion engines having two or more pistons defining variable chambers therebetween, are disclosed in other patents such as U.S. Pat. No. 2,981,243 to Arndt; U.S. Pat. No. 2,382,362, to Weinreb; U.S. Pat. No. 1,835,138, to Bowman; U.S. Pat. No. 1,744,117, to Held; U.S. Pat. No. 1,574,062, to Bohemer; U.S. Pat. No. 1,557,710, to Lennon; U.S. Pat. No. 1,521,077, to Clegg; U.S. Pat. No. 1,464,164, to Alaire; U.S. Pat. No. 1,461,080, to Berger; U.S. Pat. No. 1,138,919, to Willey et al.; U.S. Pat. No. 1,135,942, to Logan; DE U.S. Pat. No. 3,117,133.

Many other engines have been developed to modify the volume of the compression chambers and improve the compression ratio, such as U.S. Pat. No. 4,250,843, to Chang; U. S. Pat. No. 5,195,469, to Syed; U.S. Pat. No. 5,197,432, to Ballheimer; U.S. Pat. No. 5,220,890, to Iwata; E.P. Publication Nos. 0426540 A1; 0438121 A1; and WO Publication Nos. WO 92/09799, WO 93/23664 and WO 94/00681.

SUMMARY OF THE INVENTION

It is therefore one object of the present invention to provide an internal combustion engine comprising at least one cylinder and a power piston reciprocatably moving within the cylinder, wherein the cylinder stationary head of a conventional engine is replaced by a control piston interrelated to the power piston to define a combustion chamber with variable volume, the control piston being actuated by an hydraulic transmission assembly.

It is still another object of the present invention to provide an internal combustion engine having a combustion chamber with variable volume to define the best operative conditions for each of the operation cycles or stages such as, the compression rate, combustion chamber filling, combustion and exhaustion.

It is a further object of the present invention to provide an internal combustion engine that provide means for substantially entirely expelling the haust gases from the cylinder bore of the engine, as well as for getting a better incoming of the inlet mixture into the combustion chamber, wherein the mixture not only is admitted under the suction of the power piston but it is also injected into the chamber under the pressure generated by a control piston also moving within the cylinder.

It is even another object of the present invention to provide an internal combustion engine comprising a cylinder block including at least one cylinder bore, a power piston which reciprocates in the cylinder and is connected to a rod which in turn is connected to a crankshaft, a control piston reciprocating in the cylinder and a combustion chamber defined between both said pistons, the power piston and the control piston moving within the cylinder bore in a way to cause the combustion chamber to define a variable volume, the engine further comprising hydraulic transmission means connecting said control piston to the crankshaft.

It is still another object to provide an internal combustion engine comprising a power piston acting against a control piston and a combustion chamber defined between both pistons, the control piston being controlled by hydraulic transmission means to get the maximum power from the combustion cycle by generating the combustion once the lever arm defined in the crankshaft is the largest one, therefore obtaining the highest power yields, with the engine stages or cycles comprising mixture intake stage, compression stage, translation stage, explosion stage and exhaust stage. The hydraulic transmission means are regulated to move the control piston coaxially with the power piston, at the same or different speed, in the same and opposite direction. When the control piston moves at the same speed and direction like the power piston the combustion chamber will have a constant volume, while with the control and power pistons moving at different speeds the compression chamber will increase or decrease its volume.

The above combined movement of the control and power pistons not only improve the power during compression and combustion but also improves the expelling of entirely all of the burned gases without residues remaining in the compression chamber. With the inventive engine more fuel savings are obtained, the temperature is lower and the heat is rapidly dissipated, the crankshaft does not need to be reinforced, in fact it may be lighter than conventional crankshafts as long as the combustion forces are transmitted along a better lever arm with the crank at an open angular position, wherein not intermediate bearing supports are necessary but only bearings at the ends of the crankshaft may be provided.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Figures 1, 2:
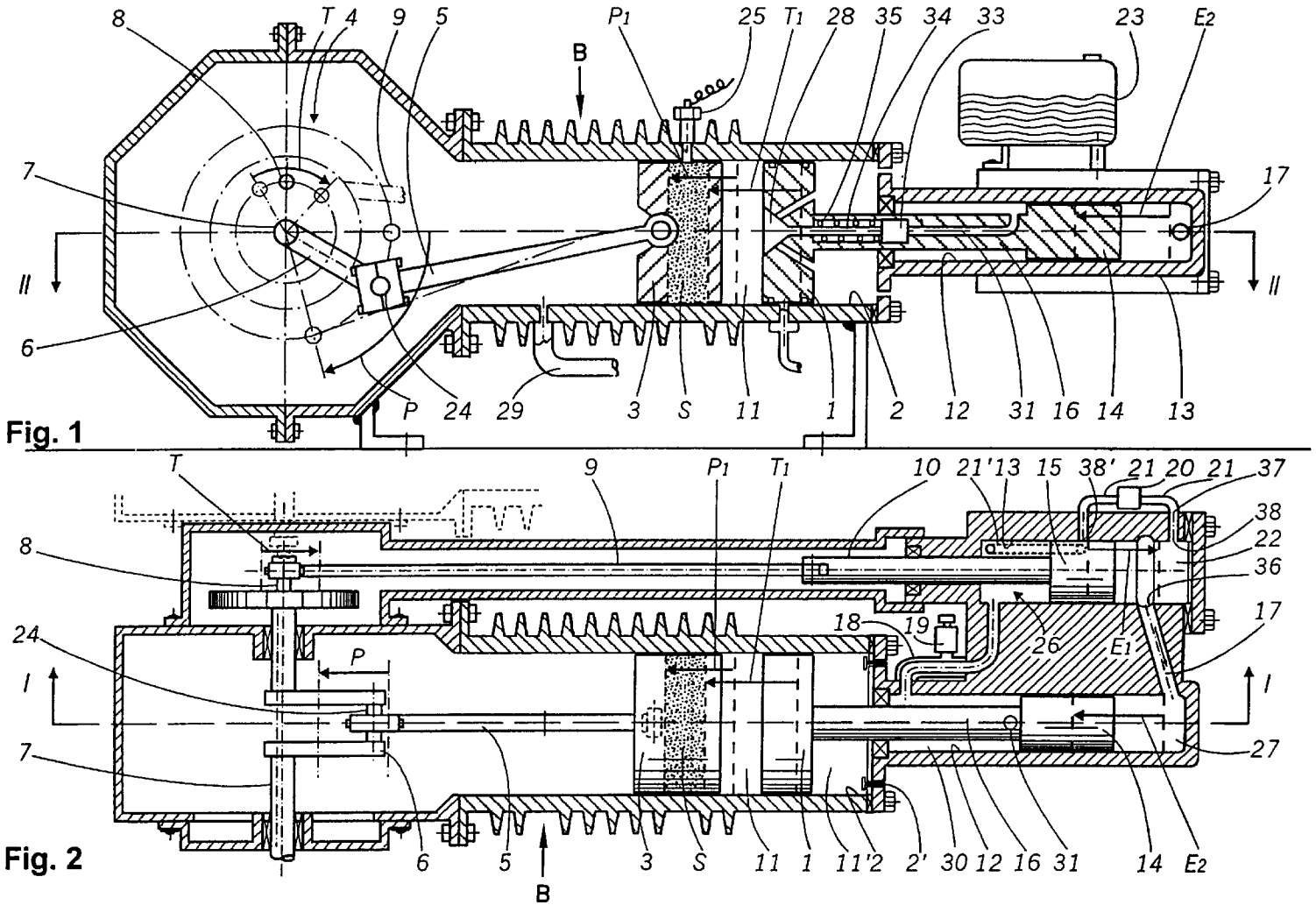
FIG. 1 shows a front elevational, cross-sectional view taken along plane I—I of FIG. 2, of an engine according to a preferred embodiment of the invention, with the components of the engine in a position corresponding to the translation stage and the circular paths of the crankshaft components illustrated in phantom lines.
FIG. 2 shows a side elevational, partial cross-sectional view taken along plane II—II of FIG. 1, with the components in the same translation stage and the power and control pistons not depicted in cross-section for clarity purposes.

Now, referring in detail to the drawings, it may be seen from FIGS. 1–10 that the engine of the invention comprises a cylinder block B including at least one cylinder bore 2, a control piston 1 and a power piston 3 capable of moving with reciprocation within cylinder bore 2, the power piston being connected to a crankshaft 4 through a rod 5. Control piston 1 is connected to the crankshaft through an inventive hydraulic transmission means to which reference will be made.

Rod 5 is connected to the crankshaft at a point 24 of a crank 6, that is at a radius or distance from shaft 7 that is larger than the radius or distance from the shaft to point 8 at which a crank 9 is connected to the crankshaft. The radius from shaft 7 to point 8 is about 15% less than the radius from shaft 7 to point 24. Crank 9 is also connected to a rod 10 which, in turn, is connected to the hydraulic transmission means of the invention. The control piston and the power piston reciprocating in the cylinder bore define, between the pistons, a combustion chamber 11 and the relative movements of the pistons are controlled by the transmission means in a way to cause the combustion chamber to define a variable volume.

The hydraulic transmission means according to the invention comprises, at least, one hydraulic chamber formed by a first hydraulic chamber 12 and a second hydraulic chamber 13, both chambers including pressurized fluid. A first hydraulic plunger 14 reciprocates within chamber 12 and is connected to the control piston through a rod 16 sealingly extending out of the hydraulic chamber and into the cylinder bore. A second hydraulic plunger 15 reciprocates within second hydraulic chamber 13 and hydraulically interacts with the first plunger, the second plunger being connected to rod 10 sealingly extending out of the hydraulic chamber and connected to the crankshaft through crank 9.

The first and second hydraulic chambers are in fluid communication through at least one communication conduit comprising a rear communication conduit 17 and a leading communication conduit 18. A volume compensating valve 19 is connected at the leading communication conduit for compensating pressure of fluid passing through the conduit, and a fluid pressure compensating valve 20 is connected at second chamber 13. Valve 20 is connected at a compensating conduit 21, having an upper orifice 38 and a lower orifice 38', communicating a second rear chamber 22 and a second leading chamber 26 separated by plunger 15. When plunger 15 moves upwardly, an its upper edge closes orifice 36, a bottom edge of the plunger uncover orifice 38' thus the fluid passes from chamber 22, via conduit 21, into chamber 26. In a like manner, a conduit 21' with its corresponding upper and lower orifices is provided for the transference of fluid from chamber 26 into chamber 22 when the plunger moves downwardly. Chamber 12 is divided by the corresponding first plunger in a first rear chamber 27 and a first leading chamber 30, said rear communication conduit 17 being in fluid communication with the first 27 and second 22 rear chambers, and leading communication conduit 18 being in fluid communication with the first 30 and second 26 leading chambers.

Figures 9, 10:
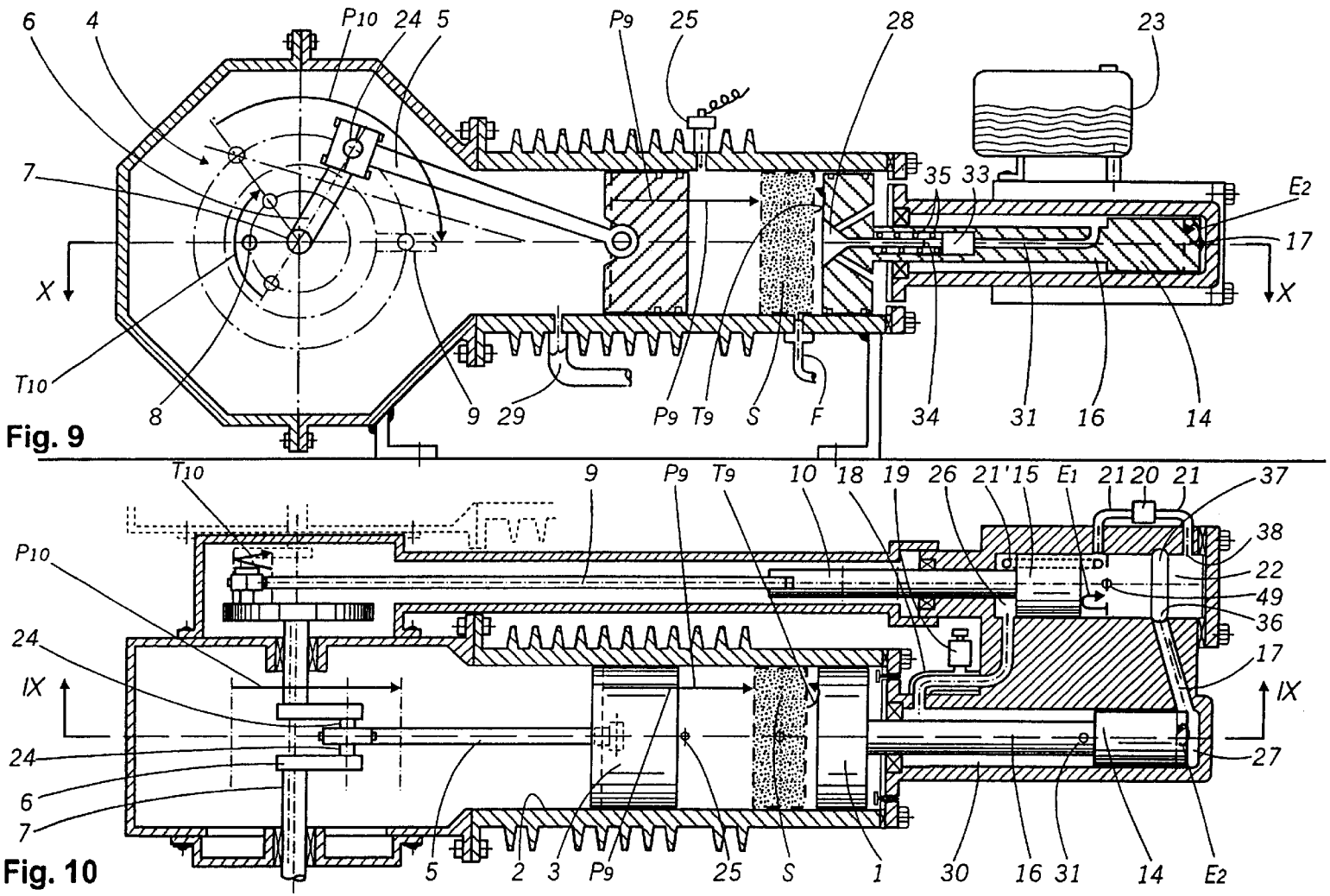
FIG. 9 shows a front elevational, cross-sectional view of the engine of FIG. 1, taken along plane IX—IX of FIG. 10, with the engine components in a position during the mixture compression stage and the circular paths of the crankshaft components illustrated in phantom lines.
FIG. 10 shows a side elevational, partial cross-sectional view taken along plane X—X of FIG. 9, with the components in the same mixture compression stage and the power and control pistons not depicted in cross-section for clarity purposes.

A tank 23 is provided containing fluid and in communication to fluid chamber 13, as indicated by reference 49 in FIG. 10. The tank operates to keep a permanent fluid flow necessary to the operation of the transmission means; this supplying tank may comprise valves to regulate the supplying of fluid without affecting the operation of the system.

According to the invention, points 8 and 24 are angularly displaced in about 100°–130°, in order that the relative movement speeds of the power and the control piston are different to each other, whereby the optimum combustion chamber volume is obtained at the corresponding cycle of operation of the engine. In other words, the point in the crankshaft at which the second plunger rod is connected is angularly displaced, relative to the rotary direction of movement of the crankshaft, at least 100° behind the point in the crankshaft at which the power piston is connected. Thus, power and control pistons move at different speeds and this is due to the fact that pivoting points 8, 24 are eccentric relative to the rotary axis of the crankshaft. Thus in certain arcs of the rotary path, the control piston moves towards the power piston at a high speed, in other paths the control piston moves towards and away from the power piston at the same speed and in other portions of the circular path the control piston moves away from the power piston at a higher speed. These conditions are selected in order that the lever arm of the crank is optimum at the explosion cycle or stage, thus transmitting all of the energy to the crankshaft. At this stage, the control piston remains firm to resist the explosion without moving back.

FIGS. 1, 2 shows the inventive engine during a translation stage or cycle wherein the angular displacement of points 8, 24, are indicated by arrows T and P, while the longitudinal strokes of pistons 1 and 3 are indicated by arrows T1 and P1. When piston 3 moves along a back stroke, toward its lower dead point, point 24 of crank 5 slowly moves along an arc of about 60°, plunger 15 within chamber 13 moves fast, indicated by E1, causing plunger 14 to move downwards, indicated by E2, and the control piston is moved fast, as indicated by T1, towards piston 3 thus increasing the compression within chamber 11. Thus, an overcompression is achieved within the combustion chamber. This may be seen from the length of displacements T1 and P1. It is easy to see that chamber 11 has a smaller volume as it moves closer to the point wherein the explosion is to occur, namely when the translation stage is over. Shadow S is used to indicate how the volume of chamber 11 has decreased as compared to the volume at the beginning of this stage. During this translation stage, control piston 1 moves towards piston 3 to be closer and closer until chamber 11 is at the position of a sparkplug 25. The downwards movement of piston 1 is produced by the upwards movement of plunger 15 that pressurizes the fluid within rear chamber 22, conduit 17 and rear chamber 27. The movement of plunger 14 compresses the fluid within chamber 30 and fluid passes through conduit 18 into leading chamber 26.

Figure 3:
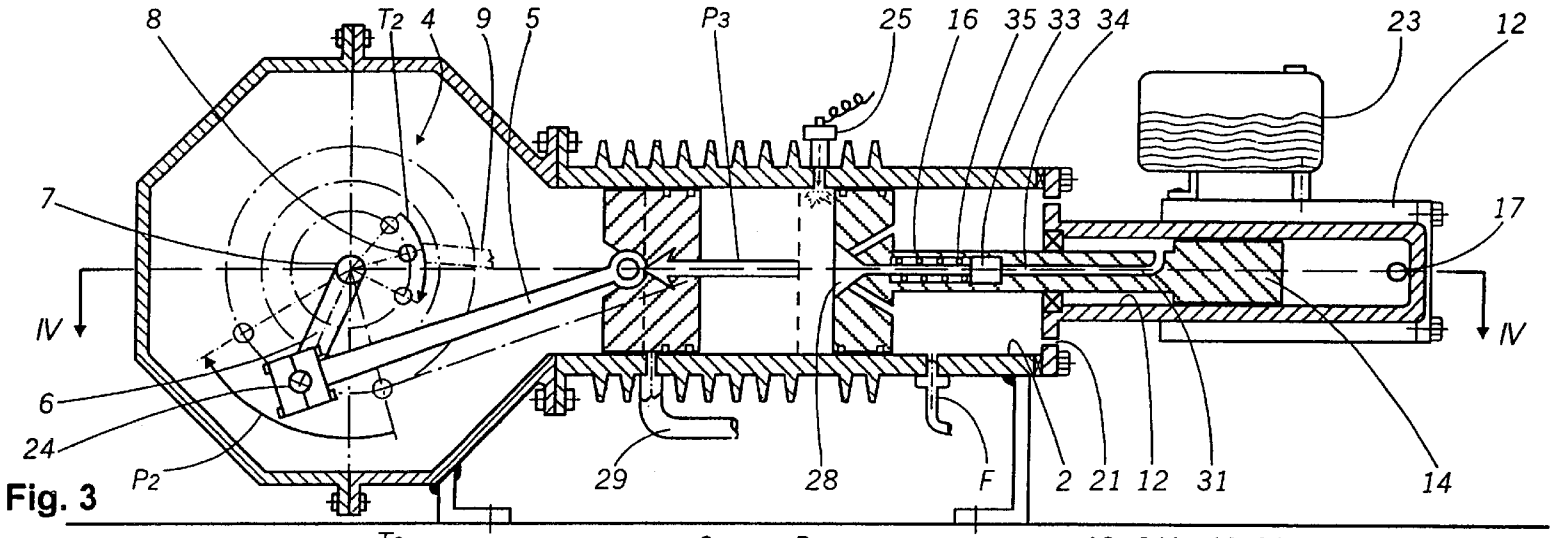
FIG. 3 shows a front elevational, cross-sectional view of the engine of FIG. 1, taken along plane III—III of FIG. 4, with the engine components in a intermediate position in the expansion/explosion stage and the circular paths of the crankshaft components illustrated in phantom lines.
Figure 4:
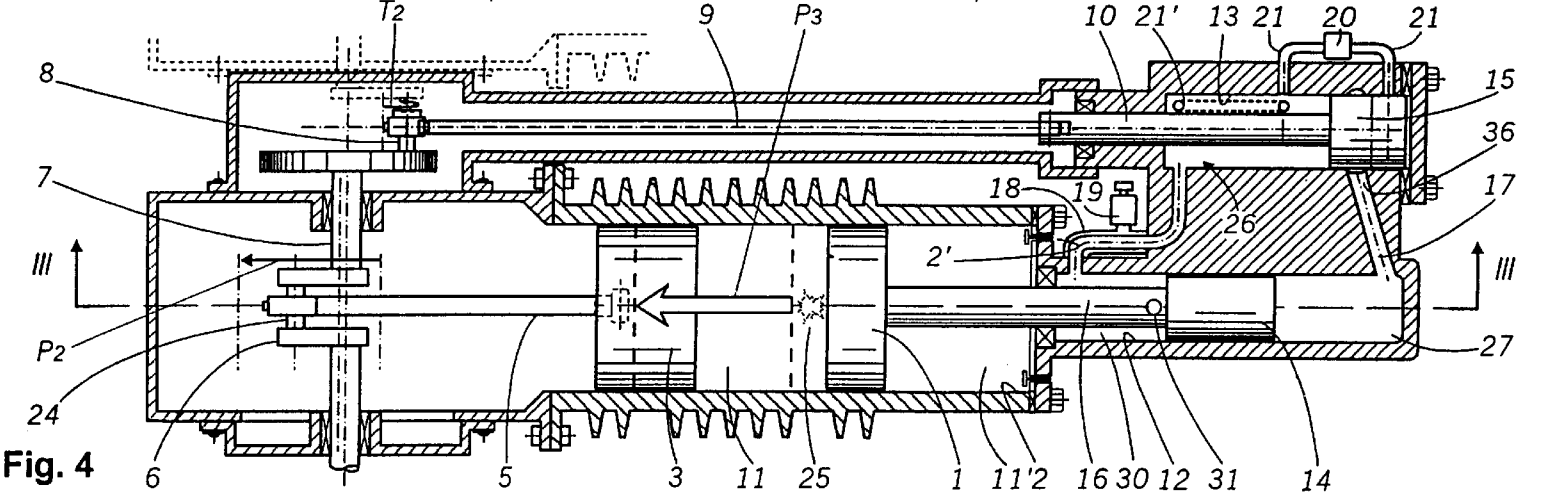
FIG. 4 shows a side elevational, partial cross-sectional view taken along plane IV—IV of FIG. 3, with the components in the same expansion or explosion stage and the power and control pistons not depicted in cross-section for clarity purposes.

FIGS. 3, 4, show the engine operating during the movement after the explosion stage, namely during the expansion stage, wherein the power piston is downwardly moving with the control piston remaining in its position without moving back due to the blocking effect from the pressurized fluid in chamber 27. Thus, piston 3 downwardly moves fast as indicated by P3, pivoting point 24 moves along the arc indicated by P2, plunger 15 remains stationary in the explosion moment closing orifice 36 to conduit 17, and plunger 14 remains in the position blocked by the fluid compressed in chamber 27. The time plungers 14, 15 remains practically stationary and does not compromise the structure as long as it is due to an hydraulic effect during the movement of crank 9 and pivoting connection 8 along arc indicated by arrow T2 in FIGS. 3 and 4.

It is also to be remarked that the regulation of relative positions and dimensions of the engine components is substantially simple and the explosion is produced once the best lever arm for point 24 is achieved, namely after moving along arc P2 of FIG. 3. The degrees for regulation and settlement of the engine may be easily obtained either by moving forward or rearward the relationship between the pistons.

Figures 5, 6:
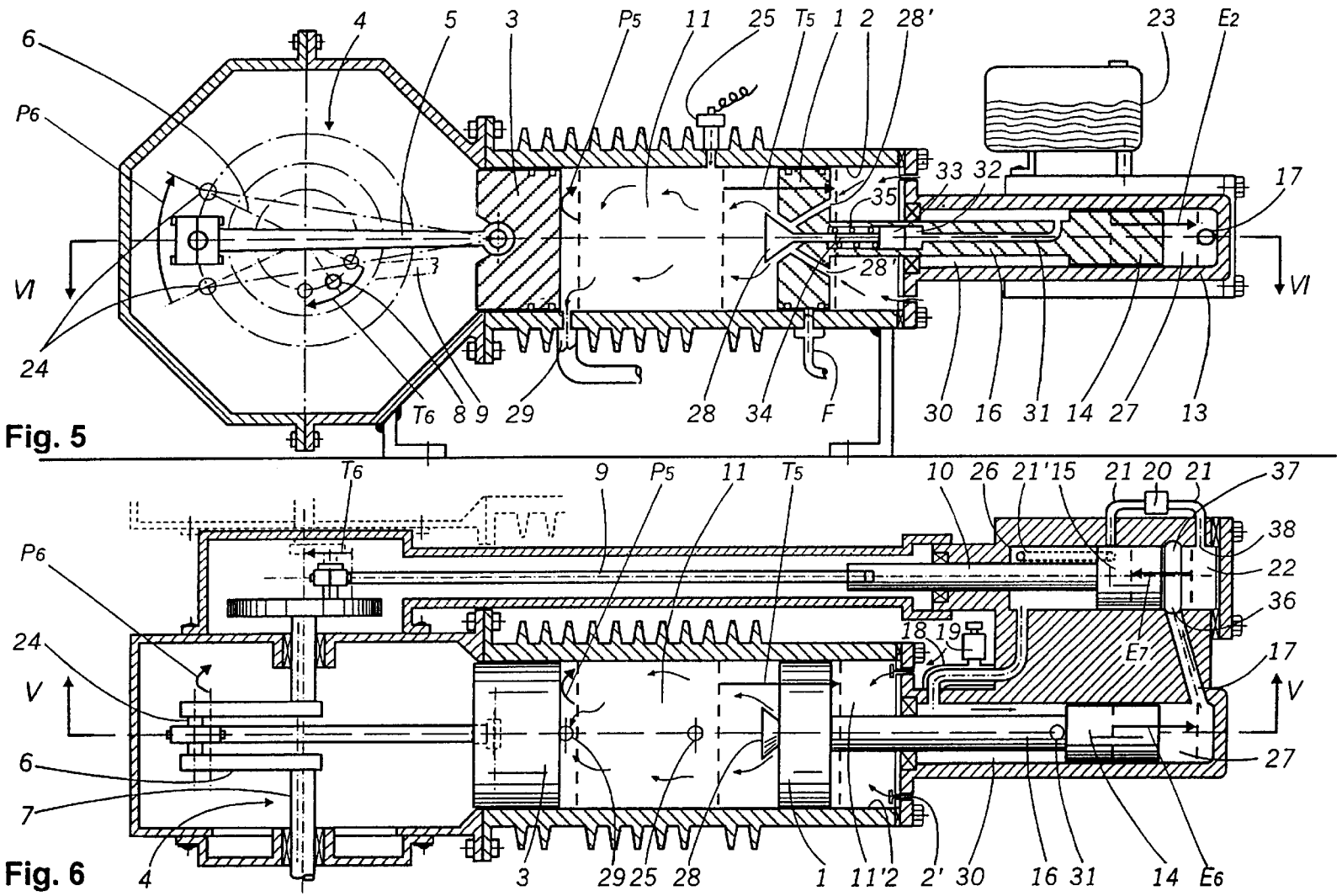
FIG. 5 shows a front elevational, cross-sectional view of the engine of FIG. 1, taken along plane V—V of FIG. 6, with the engine components in a intermediate position in the exhaust stage and the circular paths of the crankshaft components illustrated in phantom lines.
FIG. 6 shows a side elevational, partial cross-sectional view taken along plane VI—VI of FIG. 5, with the components in the same exhaust stage and the power and control pistons not depicted in cross-section for clarity purposes.

FIGS. 5, 6, show the engine components during the exhaust stage, wherein power piston 3 has moved back up to its lower dead point and control piston 1 begins with a backward or upward fast movement. Control piston 1 includes a valve 28 actuated by the fluid pressure of the hydraulic transmission means for opening and closing air intake ports 28'. Cylinder bore 2 includes at an upper end thereof, at pre-chamber 11', air intake ports 2'.

When piston 1 moves upwardly, valve 28 opens to permit. the air remaining in pre-chamber 11' entering chamber 11 thus assisting in scavenging the burned gases and exhausting these gases through an exhaust outlet 29. This exhaustion or scavenging is achieved in an optimum manner when piston 1 is moving fast upwardly. This effect is illustrative from seeing indications P1 and T1. The operation of valve 28 will result more evident from the later reference to FIG. 14.

Points 8 and 24 move along arc T6 and P6. Thus, plunger 15 moves fast downwardly along E7 causing also a fast upward movement of plunger 14 along E6 and piston 1 along T5. The fluid is compressed within chamber 27 and moved through conduit: 17 into chamber 22. Simultaneously, the fluid in chamber 26 is moved through conduit 18 and passed into chamber 30.

Figures 7, 8:
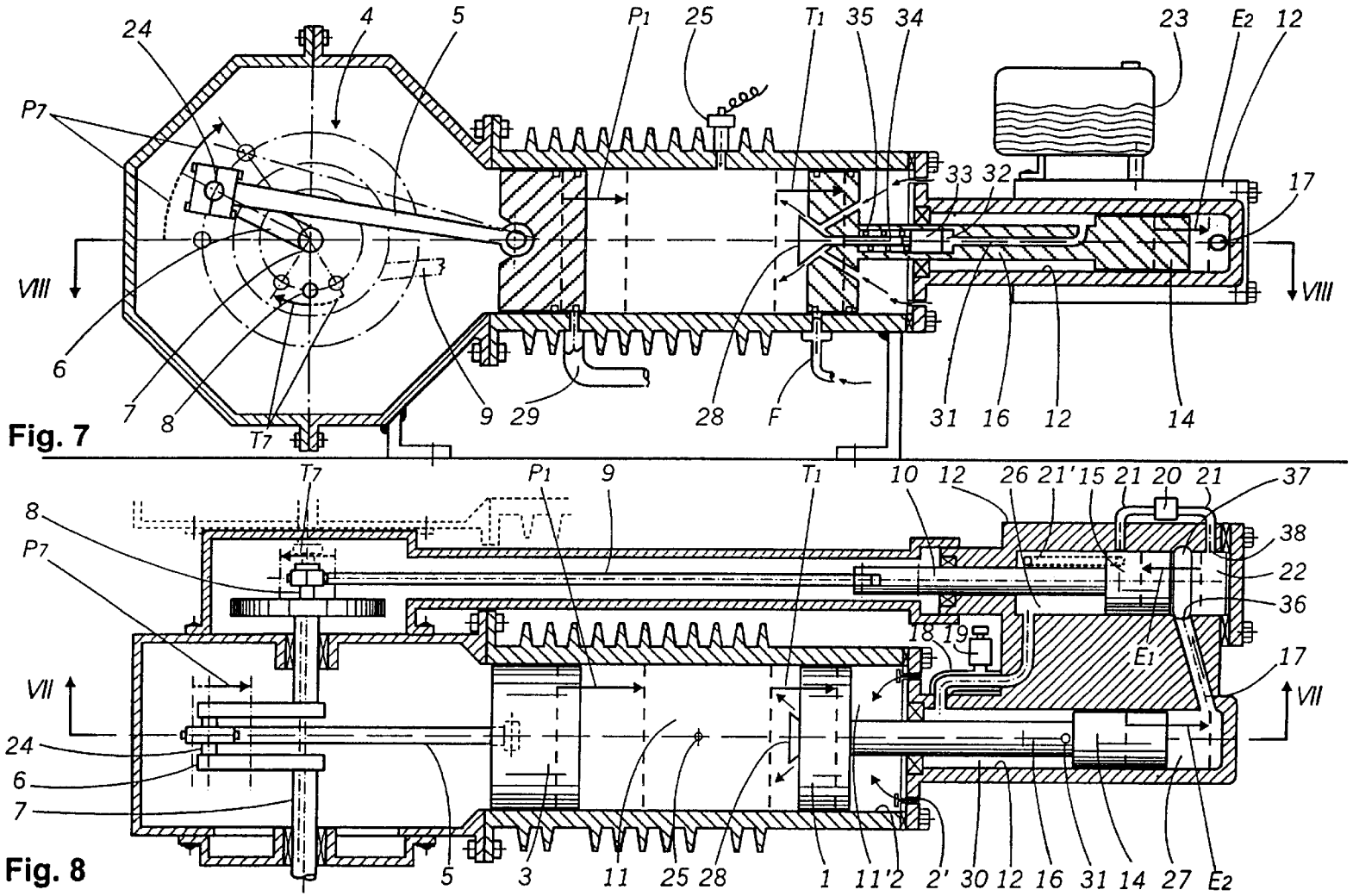
FIG. 7 shows a front elevational, cross-sectional view of the engine of FIG. 1, taken along plane VII—VII of FIG. 8, with the engine components in a position during the mixture intake stage and the circular paths of the crankshaft components illustrated in phantom lines.
FIG. 8 shows a side elevational, partial cross-sectional view taken along plane VIII—VIII of FIG. 7, with the components in the same mixture intake stage and the power and control pistons not depicted in cross-section for clarity purposes.

FIGS. 7, 8 show the pistons at the end portions of their exhaust strokes and the beginning of admission of air/fuel mixture. This is indicated by the phantom line and solid line portions of arrows T7 and P7. More precisely, the exhaust stage is completed when the power piston, in its upward stroke, closes the exhaust outlet 29, clearly shown in FIG. 7.

Piston 3 upwardly moves along its compression stage indicated in FIGS. 9, 10, and while control piston 1 moves slowly towards and away from its upper dead point, along a stroke indicated by T9, power piston 3 moves fast indicated schematically by a larger arrow P9 to form the combustion chamber 11 indicated in shadow. The arcs along which the crankshaft has rotated are indicated by T10 for point 8 and P10 for point 24. Arc T10 is related to stroke T9 and arc P10 is related to stroke P9. Then both pistons 1 and 3 move downwardly together, with piston 1 moving fast as indicated by larger arrow T1 in FIGS. 1, 2 and piston 3 moving slowly as indicated by shorter arrow P1 in FIGS. 1, 2. Once in the position shown in FIGS. 1, 2, the spark is generated and explosion produces the expansion stage shown in FIGS. 3, 4.

First 14 and second 15 plungers have distinct diameters and distinct strokes, such strokes and diameters being proportionally interrelated in order that both plungers provide a constant fluid transmission. The design of plungers 14, 15 as well as chambers 12, 13 will depend on the behavior desired for control piston 1 and any dimension relationship will fall within the concepts of the invention.

Figure 14:
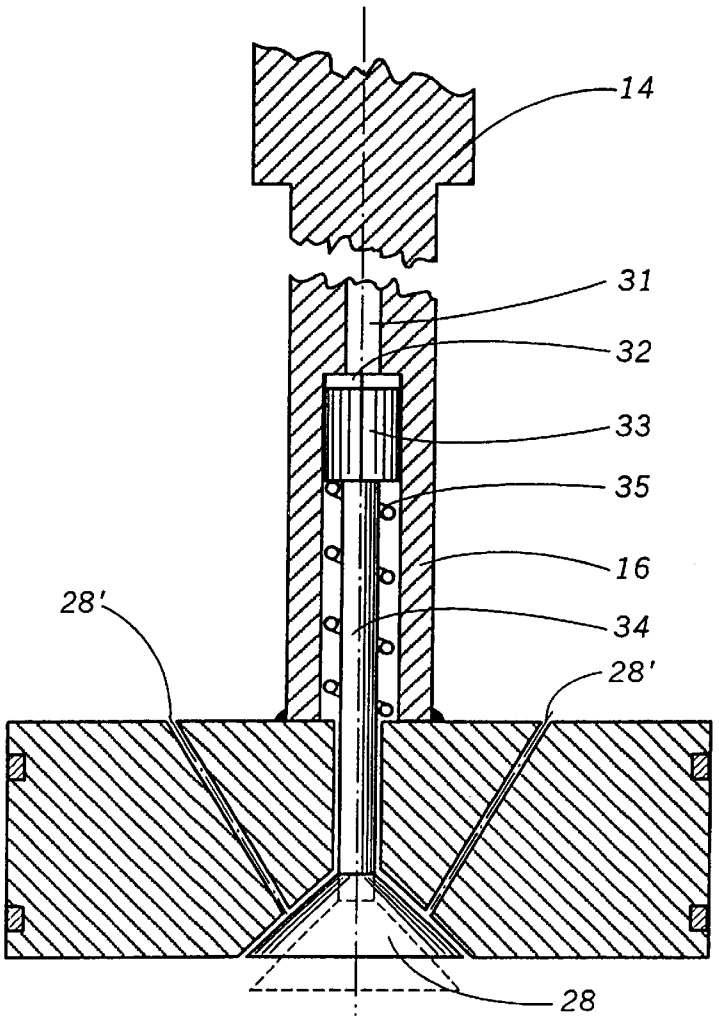
FIG. 14 shows a cross-sectional view of valve means of the control piston, with the valve in solid lines illustrating a closing position and the phantom lines indicating an opening position permitting the air intake to the combustion chamber.

FIG. 14 shows a valve 28 according to a preferred embodiment of the invention, which valve is, among other purposes, for admitting air into chamber 11. As explained above, air entering through inlets 28' serves to scavenging the burned gases out from the cylinder bore through exhaust outlet 29. Air enters chamber 11 with a flushing pattern, under pressure, because of the pressurization generated during the upward movement of the control piston that pressurizes the air within pre-chamber 11'. The operation of valve 28 is enhanced by the hydraulic transmission system of the invention as it will be explained. Rod 16 connecting first plunger 14 to control piston 1 includes an inner rod conduit 31 in fluid communication with first leading chamber 30. An inner chamber 32 is defined within rod 16 and an inner plunger 33 is housed within chamber 32, which plunger 33 is connected to a stem 34 having at its lower end the valve 28. Valve 28 is a normally closed valve, therefore a spring 35 is provided to keep valve 28 closed upon lack of a predetermined pressure differential between both leading and rear sides of the control piston.

Valve 28 remains open, as it is indicated by phantom lines in FIG. 14, when control piston moves upwardly, towards its upper dead point, at an end portion of the exhaust stroke and during the admission stage. Then, during the compression stage, valve 28 remains closed, as indicated in solid lines in FIG. 14. This valve is also closed during the translation stroke with the control and power pistons moving downwardly together. After the explosion of the explosive mixture within the combustion chamber, with the power piston moving fast towards its lower dead point and outlet 29 opens to chamber 11, valve 28 opens due to the depression generated within chamber 11, thus allowing a flushing air entering the combustion chamber to guarantee a complete scavenging of burned gases. This flushing air continues entering and will serve during the next admission stage when control piston moves upwardly and the mixture that has entered through fuel inlet F and air inlets 2', is compressed to pass through inlets 28' into chamber 11.

In the admission stage, when piston 1 upwardly moves fast, the fluid within chamber 26 is compressed and passed through conduit 18 into chamber 30, thus entering also conduit 31 and acting on plunger 33 to open the valve. Alternatively, orifice 36 at conduit 17 may have a straight cut in an upper edge thereof in order to obtain an instantaneous and no progressive interruption in the fluid passing through conduit 17, thus getting efficiency and precision in the stopping and changes in the movement directions of plungers and control piston.

Chamber 22 may also be provided with an annular notch 37 at the section of orifice 36, the notch serving to assure that the fluid moving towards conduit 17 enters the conduit in all the perimeter of plunger 15 without causing undesired lateral pressures that would cause lateral movement of the plunger and premature wearing.

Figure 11:
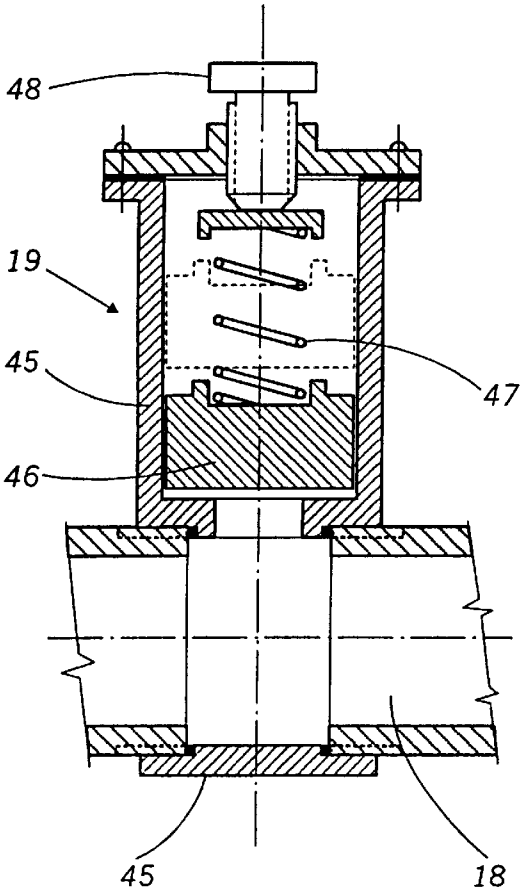
FIG. 11 shows a cross-sectional view of a pressure regulating valve connected in the leading communication conduit for compensating the return fluid passing through the conduit.

FIG. 11 shows a detailed cross-section of valve 19 provided in conduit 18. Valve 19 is a damping valve acting as a temporary reservoir of fluid when a pressure excess is detected in the fluid flow. Valve 19 comprises a cylindrical body 45 connected to conduit 18 and housing a plunger 46 closing the pass to the flow under the action of a spring 47 but opening the path for pressure relief under a desired predetermined pressure value. The pressure of spring 47 may be regulated by screw 48.

Figure 12:
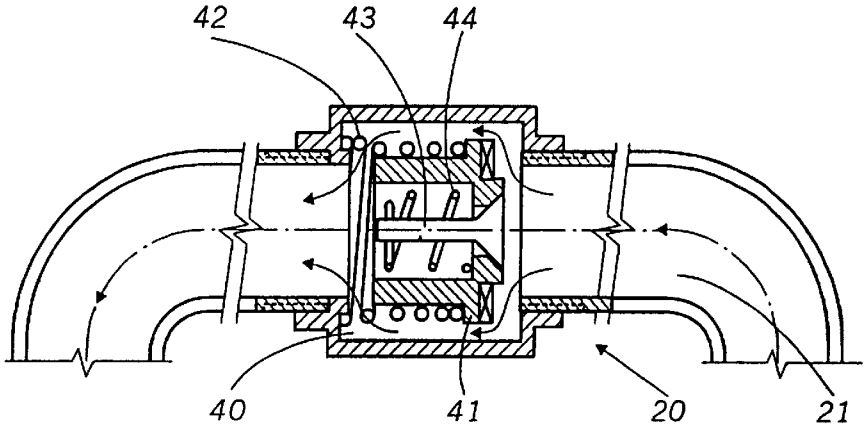
FIG. 12 shows a cross-sectional view of a fluid pressure compensating valve connected to the hydraulic chamber of the hydraulic transmission means, the valve being for compensating volumes in the hydraulic circuit, with the fluid circulating in one direction.
Figure 13:
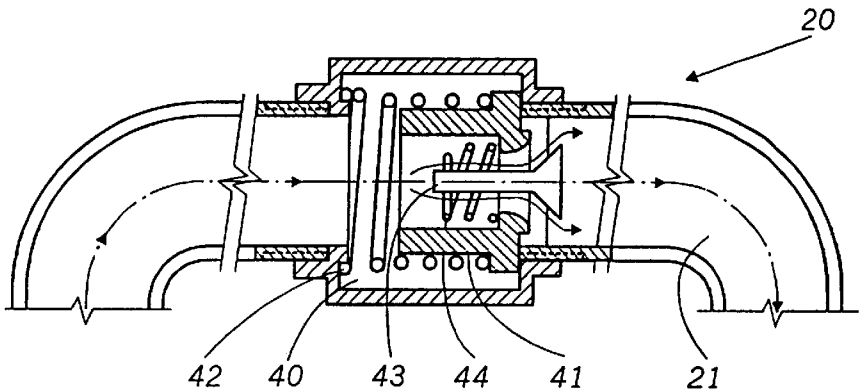
FIG. 13 shows a cross-sectional view of the pressure compensating valve of FIG. 12, with the fluid circulating in an opposite direction.

FIGS. 12 and 13 show in detail valve 20 provided at compensating conduit 21 for compensating the several pressure needs upon the variations and changes in the flow directions and hydraulic pressures, particularly when working at low rates. Valve 20 is a double-effect valve and comprises a housing 40 with a hollow plunger 41 that, under the action of spring 42, closes the pass to the fluid flow when the flow pressure is low. Housing 41 also houses a second plunger 43 that, under the action of a spring 44, closes the fluid circulation, in a direction opposite to the direction shown in FIG. 12, when the pressure is low. The flow directions are shown by corresponding arrows in FIGS. 12 and 13.

Figure 15:
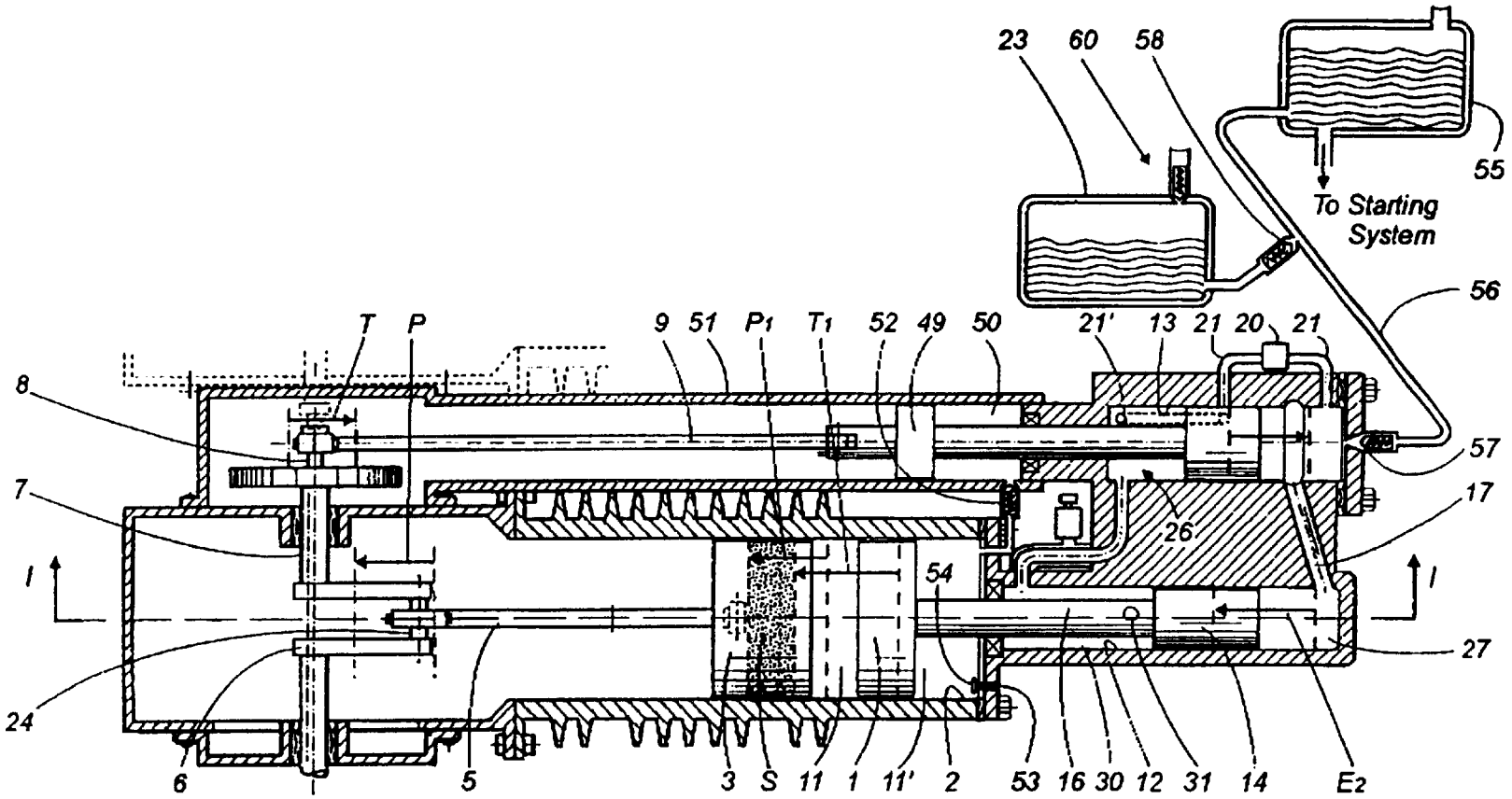
FIG. 15 shows a front elevational, cross-sectional view, similar to FIG. 1, of an engine according to an alternative embodiment of the invention.

FIG. 15 shows a cross-sectional view of another alternative embodiment of the invention wherein the same reference numbers have been maintained to identify the same equivalent components as illustrated in the remaining Figures. This embodiment is provided with air overcharging means to provide the engine with extra pressurized air charge during combustion. The overcharging means comprise a third plunger 49, namely an overcharge plunger, connected to rod 10, the third plunger reciprocating within an air pressure chamber 50 defined by a cylindrical casing 51 and in fluid communication with an upper end of the cylinder bore, particularly with pre-chamber 11' in order to provide pressurized air into the cylinder bore to act against a rear side of control piston 1. A check valve 52 is connected at a conduit between air pressure chamber 50 and pre-chamber 11' for permitting the air passing only in one direction, into the pre-chamber. According to this aspect of the invention the scavenging of burned gases and the intake of combustible mixture is produce by means of two air flows entering the pre-chamber. When the power piston is about to reach its upper dead point, the control piston begins to move towards the power piston. This movement produces a vacuum in pre-chamber 11' and air naturally enters the pre-chamber under the suction effect of the vacuum through an air intake port 53 provided with an only-one-way valve, namely a check valve 54. Thus, pressurized air is kept trapped within chamber 11'. After the explosion has occurred and the power piston is about to reach exhaust outlet 29, plunger 49 will be at the upper dead point and all the air compressed within chamber 50 will have been transferred to pre-chamber 11', thus increasing a lot the pressure within pre-chamber 11'. When outlet 29 is uncovered, the pressure within chamber 11 dramatically drops and the pressure difference between chamber 11 and pre-chamber 11' causes valve 28 to open and the pressurized air in pre-chamber 11' suddenly entering chamber 11 thus completely scavenging the burned gases out through outlet 29. This is a first air flow or flushing enhancing the complete removal of exhausted gases.

The pressures at the pre-chamber and the combustion chamber are now equalized. Then, power piston 3 moves upwardly and closes outlet 29, fuel injector F injects fuel within pre-chamber 11' which fuel mixes with the air in the pre-chamber. Then, the control piston moves fast upwardly compressing the mixture in the pre-chamber, which compressing results again in a pressure difference between the pre-chamber and chamber 11, causing valve 28 to open for permitting the entering of the mixture according to the above mentioned second flow. This second flow produces a large turbulence within the combustion chamber thus enhancing the next explosion.

Also, according to the invention, the present engine is embodied with complementary means for starting the engine. The starting means comprises a device for storing high pressure hydraulic energy useful for starting the engine when needed. The device comprises a fluid pressure storing reservoir 55 for storing high pressure fluid, the reservoir being connected to second rear chamber 22 through a conduit 56. In the connection between conduit 56 and chamber 22, a high pressure check valve 57 is provided to open when the pressure within second rear chamber 22 exceeds a predetermined pressure value and is closed when the pressure comes back to the desired value. Check valve 57 operates to permit the pressurized fluid to pass only from chamber 22 to reservoir 55, which fluid is stored for starting the engine when needed. The fluid passes through valve 57 once plunger 15 passes over orifice 36 and closes the orifice thus compressing the fluid between the orifice and the top of chamber 22. Another check valve 58, resisting a pressure higher than the pressure resisted by valve 57, is provided at conduit 56 and leads, when open, to tank 23 for storing exceeding fluid when container 55 is full. Container 23 includes a low pressure valve 60 for regulating the pressure in container 23.

While preferred embodiments of the present invention have been illustrated and described, it will be obvious to those skilled in the art that various changes and modifications may be made therein without departing from the scope of the invention as defined in the appended claims.

I claim:

1. An internal combustion engine comprising a cylinder block including at least one cylinder bore, a power piston which reciprocates in the cylinder bore and is connected to a rod which in turn is connected to a crankshaft, a control piston reciprocating in the cylinder bore and a combustion chamber defined between both said pistons, the power piston and the control piston moving within the cylinder bore in a way to cause the combustion chamber to define a variable volume, the engine further comprising:

hydraulic transmission means connecting said control piston to the crankshaft;

a pre-chamber being defined at a rear side of the control piston with the combustion chamber being defined at a leading side of the control piston whereby the combustion chamber and the pre-chamber are separated by the control piston;

valve means in the control piston, for connecting the pre-chamber with the combustion chamber in order to sequentially provide scavenging pressurized air and pressurized combustion mixture from the pre-chamber into the combustion chamber, the valve means being connected to the hydraulic transmission means, and wherein the hydraulic transmission means comprises a first hydraulic chamber and a second hydraulic chamber including pressurized fluid, a first hydraulic plunger reciprocating within the first hydraulic chamber and connected to the control piston through a rod sealingly extending out of the first hydraulic chamber and into the cylinder bore, a second hydraulic plunger reciprocating within the second hydraulic chamber and hydraulically interacting with the first plunger, the second plunger being connected to a rod sealingly extending out of the second hydraulic chamber and connected to the crankshaft.

2. The engine of claim 1, wherein the first hydraulic chamber and the second hydraulic chamber are both in fluid communication through at least one communication conduit.

3. The engine of claim 2, wherein the first and second chambers are divided by the corresponding first and second plungers into respective first rear chamber, second rear chamber, first leading chamber and second leading chamber, said at least one communication conduit comprising a rear communication conduit in fluid communication with the first and second rear chambers and a leading communication conduit in fluid communication with the first and second leading chambers.

4. The engine of claim 3, wherein the valve means in the control piston includes a valve actuated by the fluid pressure of the hydraulic transmission means for opening and closing intake ports in the control piston, for communicating the pre-chamber with the combustion chamber.

5. The engine of claim 4, wherein the rod connecting the first plunger to the control piston includes an inner rod conduit in fluid communication with the first leading chamber and the valve in the control piston, for operating the valve.

6. The engine of claim 3, wherein the leading communication conduit includes a pressure regulating valve for compensating pressure of fluid passing through the conduit.

7. The engine of claim 3, wherein the second rear chamber is connected to a fluid pressure compensating valve.

8. The engine of claim 1, wherein the rod connecting the second plunger to the crankshaft is connected to a point at a radius of the crankshaft shorter than the radius of a point in the crankshaft at which the rod connecting the power piston is connected to the crankshaft.

9. The engine of claim 8, wherein the point in the crankshaft at which the second plunger rod is connected is angularly displaced, relative to the rotary direction of movement of the crankshaft, at least 100° behind the point in the crankshaft at which the power piston is connected.

10. The engine of claim 1, wherein the first and second plungers have distinct diameters.

11. The engine of claim 1, wherein the first and second plungers have distinct strokes and diameters, said strokes and diameters being proportionally interrelated in order that both plungers provide a constant fluid transmission.

12. The engine of claim 1, wherein the cylinder bore includes, at an upper end thereof, air intake ports communicating with the pre-chamber.

13. The engine of claim 1, wherein the rod connecting the second plunger to the crankshaft includes a third plunger reciprocating within an air pressure chamber in fluid communication with the pre-chamber in order to provide pressurized air into the pre-chamber to act against the rear side of the control piston, a check valve being connected between the air pressure chamber and the pre-chamber for permitting the air passing only into the pre-chamber.

14. The engine of claim 13, wherein the upper end of the cylinder bore includes an air intake port in fluid communication with the pre-chamber, the air intake port including a check valve for permitting only the air intake to the pre-chamber.

15. The engine of claim 1, wherein the second rear chamber is connected to a fluid pressure storing reservoir, a check valve being connected between the second rear chamber and the reservoir to permit pressurized fluid passing only from the chamber to the reservoir, the reservoir containing high pressure fluid for starting the engine, the reservoir being connected to a regulating valve and container.

* * * * *